United States Patent [19]

Rey

[11] 4,068,355

[45] Jan. 17, 1978

[54] ATTACHMENT DEVICE FOR BRACELETS AND THE LIKE

[76] Inventor: Laurent C. Rey, Avenue de Lavaux 64A, 1009 Pully VD, Switzerland

[21] Appl. No.: 692,205

[22] Filed: June 2, 1976

[30] Foreign Application Priority Data

June 14, 1975 Switzerland ..... 7734/75

[51] Int. Cl.[2] ..... A44C 5/18

[52] U.S. Cl. ..... 24/265 R; 24/260; 24/265 WS

[58] Field of Search ..... 24/31, 33 R, 33 B, 33 C, 24/33 F, 260, 265 BC, 265 CC, 265 EC, 265 BH, 265 SC, 265 AL, 265 SW

[56] References Cited

U.S. PATENT DOCUMENTS

| | | | |
|---|---|---|---|
| 1,701,339 | 2/1929 | Roy | 24/265 WS |
| 1,790,721 | 2/1931 | Pretot | 24/265 WS |
| 3,042,277 | 7/1962 | Stradella | 24/265 WS |
| 3,137,027 | 6/1964 | Birkle | 24/260 |
| 3,557,412 | 1/1971 | Hauser | 24/265 WS |

FOREIGN PATENT DOCUMENTS

| | | |
|---|---|---|
| 485,442 | 3/1969 | Switzerland. |
| 346,058 | 4/1960 | Switzerland. |

*Primary Examiner*—Peter M. Caun
*Attorney, Agent, or Firm*—Mandeville and Schweitzer

[57] ABSTRACT

A clasp or the like is secured to a bracelet by a device comprising a U-shaped piece fitted on a flat end part of the bracelet. Complementary grooves and recesses in the bracelet and piece are held in locking engagement by a sleeve which fits over the piece. The clasp is attached by a spring bar inserted in a space between the end of the bracelet and the bottom of the U, and prevents removal of the sleeve.

4 Claims, 4 Drawing Figures

ATTACHMENT DEVICE FOR BRACELETS AND THE LIKE

The invention relates to devices for securing a member, such as a clasp, to the end of an elongated strip such as a bracelet.

There are known securing devices which are welded to the end of a flexible bracelet. However, adjusting the length of such a bracelet to fit a wearer's wrist involves removal of the welded securing device. Although this operation is not particularly difficult in the case of gold bracelets, it cannot be employed with gold-plated bracelets which would be damaged.

The invention aims to provide a securing device which enables a rapid and inexpensive adjustment of the length of a bracelet or similar strip to which it is fitted, without damaging the bracelet.

According to the invention, there is provided, in combination with an elongated strip, such as a bracelet, having a flat end, a device for securing a member, such as a clasp, to the flat end of the strip, said device comprising a securing piece having a flat part with engagement means able to cooperate with complementary means on the flat end of the strip to hold the securing piece relative to the strip when they are applied together, the securing piece also having means for attaching said member, and a locking sleeve engageable on said end of the strip and the securing piece, when the securing piece is placed with its engagement means facing the complementary means of the strip, to lock the securing piece on the strip.

An embodiment of the invention is shown, by way of example, in the accompanying drawings, in which.

Figure 1:
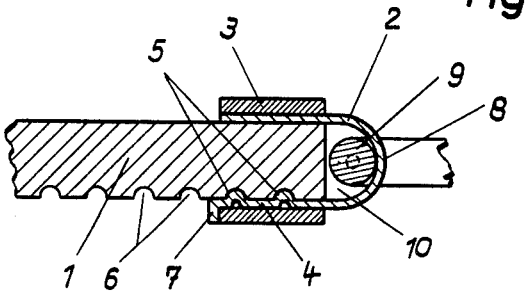
FIG. 1 is a longitudinal cross-section of an end of a bracelet to which a member is attached by a securing device.
Figure 2:
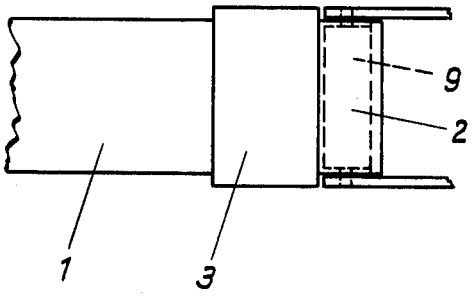
FIG. 2 is a plan view corresponding to FIG. 1.
Figure 3:
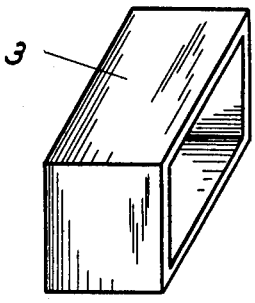
FIGS. 3 and 4 are perspective views of two elements of the securing device of FIG. 1.
Figure 4:
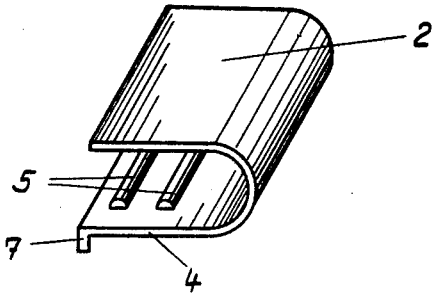

FIGS. 1 and 2 show a flat end part of a flexible bracelet 1, on which a securing piece 2 is held by a sleeve 3. Piece 2 is formed by a bent metal plate of U section, as shown in FIG. 1. One, 4, of the facing flat parts of piece 2 has two transverse ribs 5, and the end part of bracelet 1 has a series of transverse grooves 6 complementary to the ribs 5. The free end of part 4 has an outwardly-directed flange 7 forming a stop against which the sleeve 3 abuts. Piece 2 has a curved part 8 forming means for attaching a member 9 which, in the illustrated example, is a spring bar of a clasp. In effect, the part 8 defines a space 10 in which the spring bar 9 to be attached is received and held in place when the ends of the clasp have been fitted on the spring-urged pins of bar 9.

To secure the device to the end of bracelet 1, the bracelet is cut to the desired length so that it will closely fit on the wearer's wrist, and the securing piece 2 is fitted onto the cut endwith the two ribs 5 engaging in the two grooves 6 nearest the end of the bracelet. Then, the sleeve 3 is slid over the piece 2 until it abuts against the flange 7, the sleeve 3 being held by friction. Finally, the spring bar 9 is inserted in the space 10 and a member, such as a clasp, is fitted on the bar 9. Once the device has been secured in this manner, the bracelet cannot be removed from the sleeve 3 as a result of traction on the bracelet, because of the locking engagement of the ribs 5 in grooves 6, and because of the presence of the flange 7. Unwanted removal in the opposite direction is prevented by the bar 9 which contacts the end of the bracelet 1. Also, the attached clasp or other member forms a stop which limits movement of the sleeve 3 towards the right (FIGS. 1 and 2), and hence holds the assembly together.

If the bracelet has to be shortened again, the clasp or other member is removed by releasing the spring-urged pins of bar 9, the bar 9 is removed, the sleeve 3 slid off, and the piece 2 is removed from the end of the bracelet 1. Then the unwanted part of the end of the bracelet 1 is cut off, and the device is replaced in the same manner as before.

What is claimed is:

1. Apparatus for adjustably securing a connector to the end of an enlongated strip, comprising a. an elongated strip with a flat end;

b. said flat end having a plurality of spaced first engaging means on one surface thereof; the improvement comprising c. a securing piece comprising a body portion with opposed spaced-apart legs for engaging opposite surfaces of said flat end;

d. one of the flat end engaging surfaces of one of said spaced-apart legs having a plurality of spaced second engaging means for cooperating with said first engaging means;

e. radially extending stop means on one end of one of said spaced-apart legs;

f. a locking sleeve extendible over said legs on said flat end and engagable with said stop means; and g. a connector for said elongated strip for holding said sleeve in engagement with said stop means, said connector including means for extending between the end of said strip and said body portion of said securing device.

2. The apparatus of claim 1, further characterized by a. said first and second cooperating means are spaced apart protuberances and recesses.

3. The apparatus of claim 1, further characterized by a. said securing piece being substantially U-shaped in cross section with a curved body portion.

4. The apparatus of claim 3, further characterized by a. said extending means on said connector is an elongated bar with spring urged pins at each end.

* * * * *